US006503134B2

(12) United States Patent
Shendon

(10) Patent No.: US 6,503,134 B2
(45) Date of Patent: Jan. 7, 2003

(54) CARRIER HEAD FOR A CHEMICAL MECHANICAL POLISHING APPARATUS

(75) Inventor: Norm Shendon, San Carlos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/878,004

(22) Filed: Jun. 8, 2001

(65) Prior Publication Data

US 2001/0044268 A1 Nov. 22, 2001

Related U.S. Application Data

(63) Continuation of application No. 09/456,889, filed on Dec. 7, 1999, now Pat. No. 6,267,656, which is a continuation of application No. 09/090,647, filed on Jun. 4, 1998, now Pat. No. 6,019,671, which is a division of application No. 08/835,070, filed on Apr. 4, 1997, now Pat. No. 5,913,718, which is a continuation of application No. 08/205,276, filed on Mar. 2, 1994, now Pat. No. 5,643,053, which is a continuation-in-part of application No. 08/173,846, filed on Dec. 27, 1993, now Pat. No. 5,582,534.

(51) Int. Cl.[7] ..... B24B 5/02

(52) U.S. Cl. ..... 451/398; 451/288; 451/290

(58) Field of Search ..... 451/397, 398, 451/287, 288, 289, 290

(56) References Cited

U.S. PATENT DOCUMENTS

| | | | |
|---|---|---|---|
| 34,425 | A | 11/1862 | Schultz |
| 2,687,603 | A | 8/1954 | White |
| 2,936,555 | A | 5/1960 | Junge |
| 3,137,977 | A | 6/1964 | Graves |
| 3,156,073 | A | 11/1964 | Strasbaugh |
| 3,170,273 | A | 2/1965 | Walsh |
| 3,342,652 | A | 9/1967 | Reisman et al. |
| 3,559,346 | A | 2/1971 | Paola |
| 3,579,917 | A | 5/1971 | Boettcher et al. |
| 3,731,435 | A | 5/1973 | Boettcher et al. |
| 3,748,790 | A | 7/1973 | Pizzarello et al. |
| 3,841,031 | A | 10/1974 | Walsh |
| 3,906,678 | A | 9/1975 | Roth |
| 3,913,271 | A | 10/1975 | Boettcher et al. |

(List continued on next page.)

FOREIGN PATENT DOCUMENTS

| | | |
|---|---|---|
| DE | 3411120 | 11/1984 |
| DE | 4302607 | 1/1993 |
| EP | 0 121 707 | 10/1984 |
| EP | 0 593 057 | 4/1994 |
| JP | 1109066 | 4/1989 |
| JP | 1216768 | 8/1989 |

*Primary Examiner*—Timothy V. Eley
(74) *Attorney, Agent, or Firm*—Fish & Richardson

(57) ABSTRACT

A chemical mechanical polishing apparatus polishes the surface of a substrate to remove material therefrom. The apparatus includes a carrier, which positions the substrate against the rotating polishing pad. The carrier includes an integral loading member therein, which controls the load force of the substrate against the polishing pad. Multiple substrates may be simultaneously polished on a single rotating polishing pad, and the polishing pad may be rotationally oscillated to reduce the likelihood that any contaminants are transferred from one substrate to another along the polishing pad. A multi-lobed groove in the polishing pad may be used, in conjunction with a moving substrate, to polish the surface of the substrate.

14 Claims, 5 Drawing Sheets

U.S. PATENT DOCUMENTS 3,962,832 A 6/1976 Stasbaugh
3,978,622 A 9/1976 Mazur et al.
3,986,433 A 10/1976 Walsh et al.
4,143,490 A 3/1979 Wood
4,239,567 A 12/1980 Winings
4,256,535 A 3/1981 Banks
4,257,194 A 3/1981 Cailloux
4,270,314 A 6/1981 Cesna
4,270,316 A 6/1981 Kramer et al.
4,373,991 A 2/1983 Banks
4,380,412 A 4/1983 Walsh
4,525,954 A 7/1985 Larsen
4,653,231 A 3/1987 Cronkhite et al.
4,680,893 A 7/1987 Cronkhite et al.
4,726,150 A 2/1988 Nishio et al.
4,811,522 A 3/1989 Gill, Jr.
4,839,993 A 6/1989 Masuko et al.
4,897,966 A 2/1990 Takahashi
4,918,869 A 4/1990 Kitta
4,918,870 A 4/1990 Torbert et al.
4,940,507 A 7/1990 Harbarger
4,944,836 A 7/1990 Beyer et al.
4,956,313 A 9/1990 Cote et al.
4,992,135 A 2/1991 Doan
5,020,283 A 6/1991 Tuttle
5,036,015 A 7/1991 Sandhu et al.
5,064,683 A 11/1991 Poon et al.
5,069,002 A 12/1991 Sandhu et al.
5,081,795 A 1/1992 Tanaka et al.
5,081,796 A 1/1992 Schultz
5,095,661 A 3/1992 Gill, Jr. et al.
5,114,875 A 5/1992 Baker et al.
5,169,491 A 12/1992 Doan
5,193,316 A 3/1993 Olmstead
5,205,082 A 4/1993 Shendon et al.
5,209,816 A 5/1993 Yu et al.
5,216,843 A 6/1993 Breivogel et al.
5,222,329 A 6/1993 Yu
5,225,034 A 7/1993 Yu et al.
5,230,184 A 7/1993 Bukhman
5,232,875 A 8/1993 Tuttle et al.
5,234,867 A 8/1993 Schultz et al.
5,244,534 A 9/1993 Yu et al.
5,255,474 A 10/1993 Gawa et al.
5,297,364 A 3/1994 Tuttle
5,302,233 A 4/1994 Kim et al.
5,398,459 A 3/1995 Okumura et al.
5,423,558 A 6/1995 Koeth et al.
5,423,716 A 6/1995 Strasbaugh
5,441,444 A 8/1995 Nakajima
5,449,316 A 9/1995 Strasbaugh
5,476,414 A 12/1995 Hirose et al.
5,498,199 A 3/1996 Karlsrud et al.
5,527,209 A 6/1996 Volodarsky et al.
5,584,746 A 12/1996 Tanaka et al.
5,584,751 A 12/1996 Kobayashi et al.
5,588,902 A 12/1996 Tominaga et al.
5,605,488 A 2/1997 Oshashi et al.
5,624,299 A 4/1997 Shendon
5,643,053 A 7/1997 Shendon
5,643,061 A 7/1997 Jackson et al.
5,681,215 A 10/1997 Sherwood et al.
5,733,182 A 3/1998 Muramatsu et al.
6,019,671 A 2/2000 Shendon
6,267,656 B1 7/2001 Shendon

CARRIER HEAD FOR A CHEMICAL MECHANICAL POLISHING APPARATUS

CROSS-REFERENCE TO RELATED APPLICATIONS

This is a continuation of U.S. application Ser. No. 09/456,889; filed Dec. 7, 1999 and issued to U.S. Pat. No. 6,267,656, which is a continuation of U.S. application Ser. No. 09/090,647, filed Jun. 4, 1998 and issued as U.S. Pat. No. 6,019,671, which is a division of U.S. application Ser. No. 08/835,070, filed Apr. 4, 1997 and issued as U.S. Pat. No. 5,913,718, which is a continuation of U.S. application Ser. No. 08/205,276, filed Mar. 2, 1994 and issued as U.S. Pat. No. 5,643,053, which is a continuation-in-part of U.S. application Ser. No. 08/173,846, filed Dec. 27, 1993 and issued as U.S. Pat. No. 5,582,534.

BACKGROUND OF THE INVENTION

1. Field of the Invention

The present invention relates to the field of semiconductor processing. More particularly, the present invention relates to methods and apparatus for chemically mechanically polishing substrates with increased uniformity and reduced cost. The invention provides apparatus and methods to improve the uniformity of the rate at which material is removed from different locations on the substrate, and thereby increasing the number of useful die which are ultimately recovered from the substrate. Additionally, the present invention provides apparatus and methods for simultaneously polishing multiple substrates on a single polishing pad, thereby increasing the productivity of the chemical mechanical polishing apparatus.

2. Background of the Art

Chemical mechanical polishing, commonly referred to as CMP, is a method of planarizing or polishing substrates. CMP may be used as the final preparation step in the fabrication of substrates from semiconductor slices to provide substantially planar front and back sides thereon. CMP is also used to remove high elevation features, or other discontinuities, which are created on the outermost surface of the substrate during the fabrication of microelectronic circuitry on the substrate.

In a typical prior art CMP process, a large rotating polishing pad, which receives a chemically reactive slurry thereon, is used to polish the outermost surface of the substrate. To position the substrate on the polishing pad, the substrate is located in a carrier. The carrier is received on, or directly above, the polishing pad, and it maintains a bias force between the surface of the substrate and the rotating polishing pad. The carrier may also oscillate, vibrate or rotate the substrate on the polishing pad. The movement of the slurry whetted polishing pad across the planar face of the substrate causes material to be chemically mechanically polished from that face of the substrate.

One recurring problem with CMP processing is the tendency of the process to differentially polish the planar surface of the substrate, and thereby create localized over-polished and under-polished areas on the substrate. One area on the surface of a substrate where over-polishing commonly occurs is adjacent the substrate edge. When such edge over-polishing occurs, the polished substrate takes on a convex shape, i.e., it is thicker in the middle and thinner along its edge. If the substrate is to be further processed, such as by photolithography and etching, this thickness variation makes it extremely difficult to print high resolution lines on the substrate. If CMP is used to remove high elevation features resulting from the formation of circuitry on the working surface of the substrate, differential polishing will physically destroy any die which were formed in the over-polished areas.

Edge over-polishing is caused by several factors. Uneven distribution of the polishing enhancing slurry on the surface of the substrate is one factor which contributes to edge over-polishing. Where the slurry is more rapidly replenished, such as along the edge of the substrate, the substrate is more rapidly polished. Another factor is relative pressure between the polishing pad and the substrate at different locations on the substrate. The areas where the pressure is higher have higher polishing rates. One relatively high pressure area occurs where the substrate edge presses into the polishing pad, which causes the substrate edge to polish more rapidly than the substrate center. An additional factor, for a polishing apparatus in which the polishing pad and the substrate both rotate, is the cumulative motion between the substrate and the polishing pad. The cumulative motion may be higher near the edge of the substrate than at the substrate center. The greater the cumulative motion between the polishing pad and the substrate, the greater the quantity of material removed from the substrate. As a result of these and other factors, the substrate edge is usually polished at a higher rate than the substrate center.

Substrate over-polishing may also occur in non-contiguous areas of the substrate. This over-polishing is commonly attributed to a warped or otherwise improperly prepared substrate and is exacerbated by the mounting system which affixes the substrate to the carrier. The carrier commonly includes a generally planar lower face. A conformable material is located on this lower face to receive the substrate there against. The conformable material may be a polymer sheet, or it may be a wax mound over which the substrate is pressed to form a conformable receiving surface. The conformable material, and the lower face of the carrier, may not be as flat as the desired flatness of the substrate. Therefore, the conformable material and generally planar lower face may include protrusions which differentially load the back side of the substrate when the substrate is located on the polishing pad. This differential loading will create overloaded areas on the surface of the substrate engaged against the polishing pad which correspond to the location of the protrusions of the lower face and conformable material. In the localized areas of the substrate where this overloading occurs, the substrate will be over-polished, and the die yield from the substrate will be reduced.

In addition to the reduced die yield which results from the creation of over-polished areas on the substrate, the use of a large rotating polishing pad to sequentially process substrates is inherently inefficient. Typically, the surface area of the substrate is no more than 20% of the surface area of the polishing pad. Therefore, at any point in time, most of the polishing pad material is not in contact with the substrate. One way to increase the utilization of the surface area of the rotating polishing pad is to simultaneously process multiple substrates on the polishing pad. However, users of CMP equipment are reluctant to do so because a substrate may crack or may otherwise be defective, and chips or other contaminants will be transferred by the rotating polishing pad to all of the substrates being simultaneously processed on the polishing pad.

Therefore, there exists a need for a CMP polishing apparatus which provides (i) greater uniformity in the material removal rate between each discrete location or region on the face of the substrate and (ii) greater polishing pad utilization.

SUMMARY OF THE INVENTION

The present invention is a chemical mechanical polishing apparatus and method which includes multiple embodiments useful for increasing the uniformity of the material removal rate, or the utilization of a polishing pad, of chemical mechanical polishing equipment. In a first embodiment, the apparatus includes a substrate carrier which differentially loads selected portions of the outer surface of the substrate against the polishing pad. Where edge over-polishing occurs, the carrier may be configured to increase the pressure between the polishing pad and substrate at the center of the substrate to compensate for a high material removal rate which would otherwise occur adjacent the edge of the substrate.

In a second embodiment of the invention, the carrier is configured to load all portions of the outermost surface of the substrate equally against the polishing pad. By equally loading the substrate against the polishing pad, the incidence of localized over-polishing caused by protrusions on the conformable material or the carrier lower surface may be reduced or eliminated. To further control edge over-polishing which occurs as a result of greater cumulative movement between the substrate and the polishing pad at the substrate edge, the substrate may be orbited on the polishing pad while the polishing pad is slowly rotated. The carrier may be controlled to orbit the substrate without rotation or to rotate the substrate at a desired velocity as it is orbited. By closely controlling the rotational velocity of the substrate in comparison to the rotational velocity of the polishing pad, the mount of differential polishing of the substrate caused by differential cumulative movement at different discrete locations or regions of the substrate may be reduced or eliminated.

In a third embodiment of the invention, multiple substrate carriers are provided for simultaneously loading multiple substrates on a single polishing pad. In one sub-embodiment of the multiple carrier embodiment, the polishing pad is rotationally oscillated. By rotationally oscillating the polishing pad, the area of the polishing pad which contacts any one of the multiple substrates may be isolated from the area of the polishing pad contacting any other substrate. In an additional sub-embodiment of the invention, the polishing pad includes a groove or grooves therein, which are configured to collect any chipped portion of a substrate which may be created during processing. In a further sub-embodiment of the multiple carrier embodiment of the invention, the polishing pad is maintained in a stationary position, and a multi-lobed groove is located in the polishing pad immediately below the location at which the substrate is received on the polishing pad. The multi-lobed groove provides areas of contact and non-contact between the substrate and the polishing pad, and the slurry may be replenished in the areas of non-contact between the substrate and the polishing pad.

BRIEF DESCRIPTION OF THE DRAWINGS

These and other features of the invention will become apparent from the following description when read in conjunction with the accompanying drawings, wherein.

DESCRIPTION OF THE EMBODIMENTS

I. Introduction

The present invention provides multiple embodiments for polishing a substrate 12 on a large polishing pad with improved uniformity and yield. In each of the embodiments of the invention set forth herein, the substrate 12 is loaded against a polishing pad 22 on a polishing apparatus, such as the polishing apparatus 10 of FIG. 1, and is preferably moved in an orbital path with controlled rotation. The polishing 22 pad is preferably rotated, but it may be maintained in a stationary position as the substrate 12 is moved thereagainst.

Figure 1:
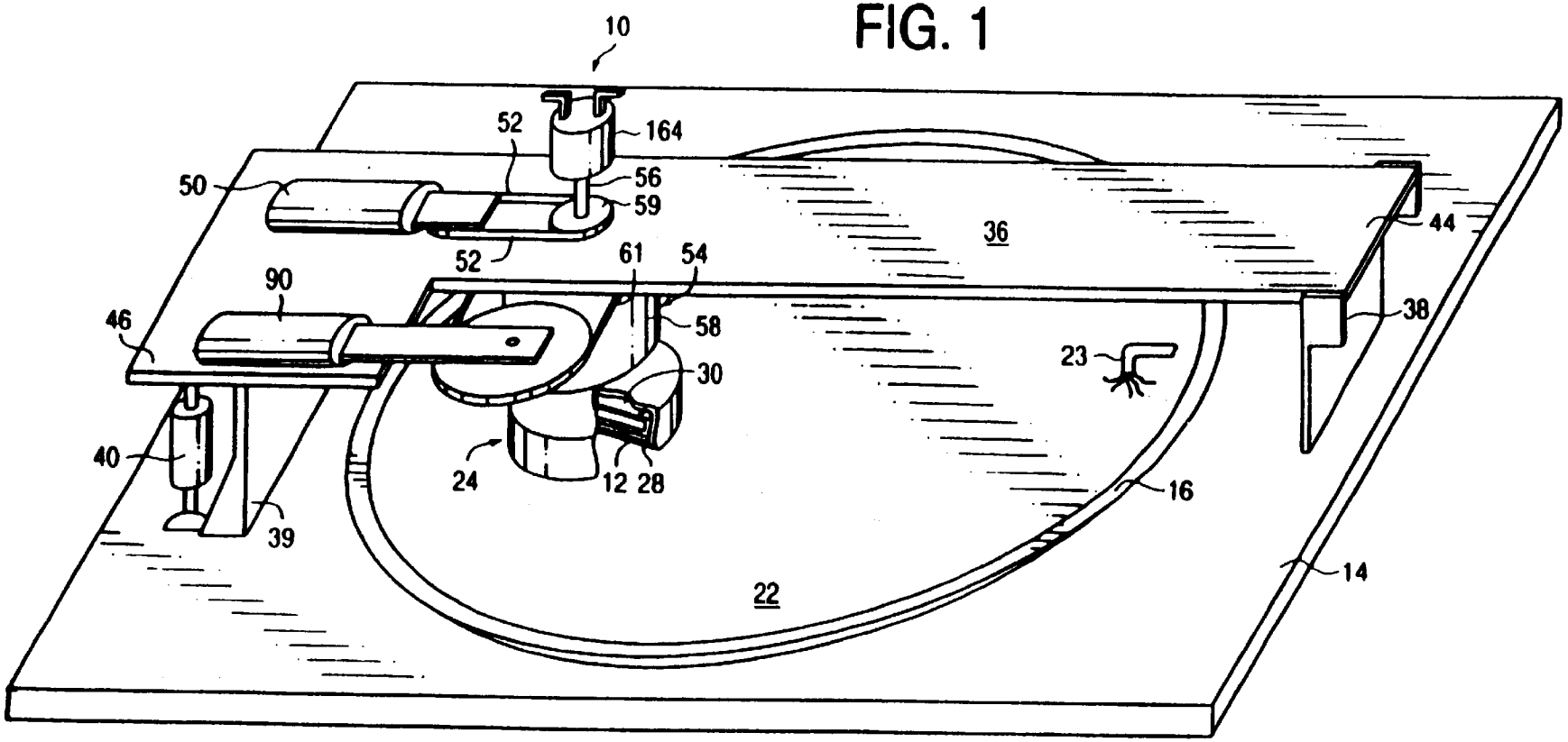
FIG. 1 is a perspective view, partially in section, of a polishing apparatus of the present invention.
Figure 2:
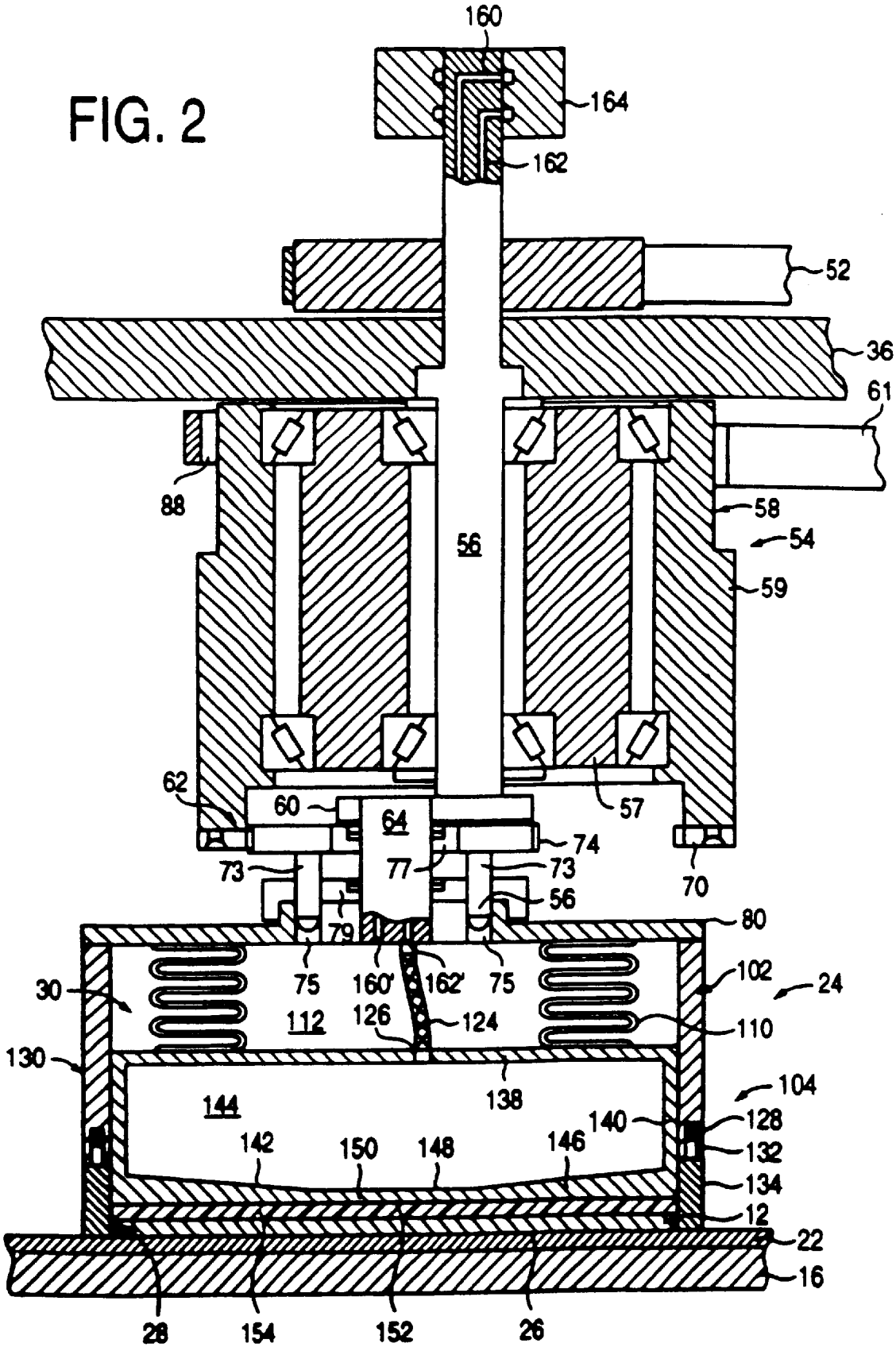
FIG. 2 is a sectional view of the substrate carrier and drive assembly of the polishing apparatus of FIG. 1.

In the embodiment of the invention shown in FIGS. 1 and 2, a substrate carrier 24 is provided to receive the substrate 12 and position the substrate 12 on the rotating polishing pad 22. The carrier 24 is coupled to a transfer case 54, which is configured to move the carrier 24, and the substrate 12 received therein, in an orbital path on the polishing pad 22 and to simultaneously control the rotational orientation of the carrier 24 and the substrate 12 with respect to a fixed point such as a base 14 of the polishing apparatus 10. The carrier 24 is configured to selectively differentially load the center of the substrate 12 as compared to the edge of the substrate 12. By differentially loading the center of the substrate 12, the material removal rate at the substrate center may be adjusted to match the material removal rate adjacent the substrate edge.

Figure 3:
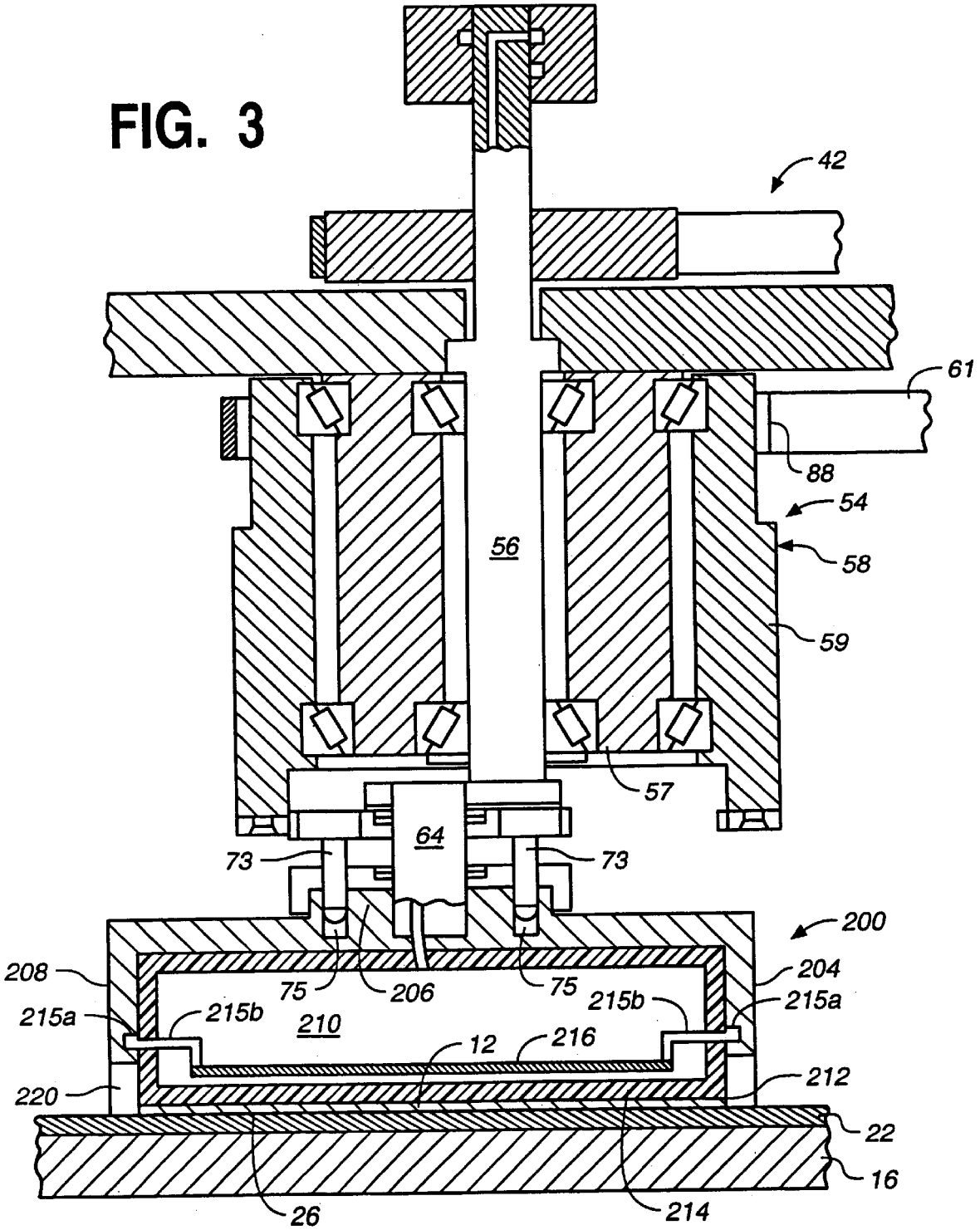
FIG. 3 is a sectional view of an alternative embodiment of the substrate carrier of FIG. 2.

In the embodiment of the invention shown in FIG. 3, the substrate carrier is configured as a front referencing carrier 200 which equally loads all locations or regions of the substrate 12 against the polishing pad 22. This reduces the occurrence of non-contiguous over-polished areas on the substrate 12 resulting from non-contiguous differentially loaded areas of the substrate 12.

Figure 4:
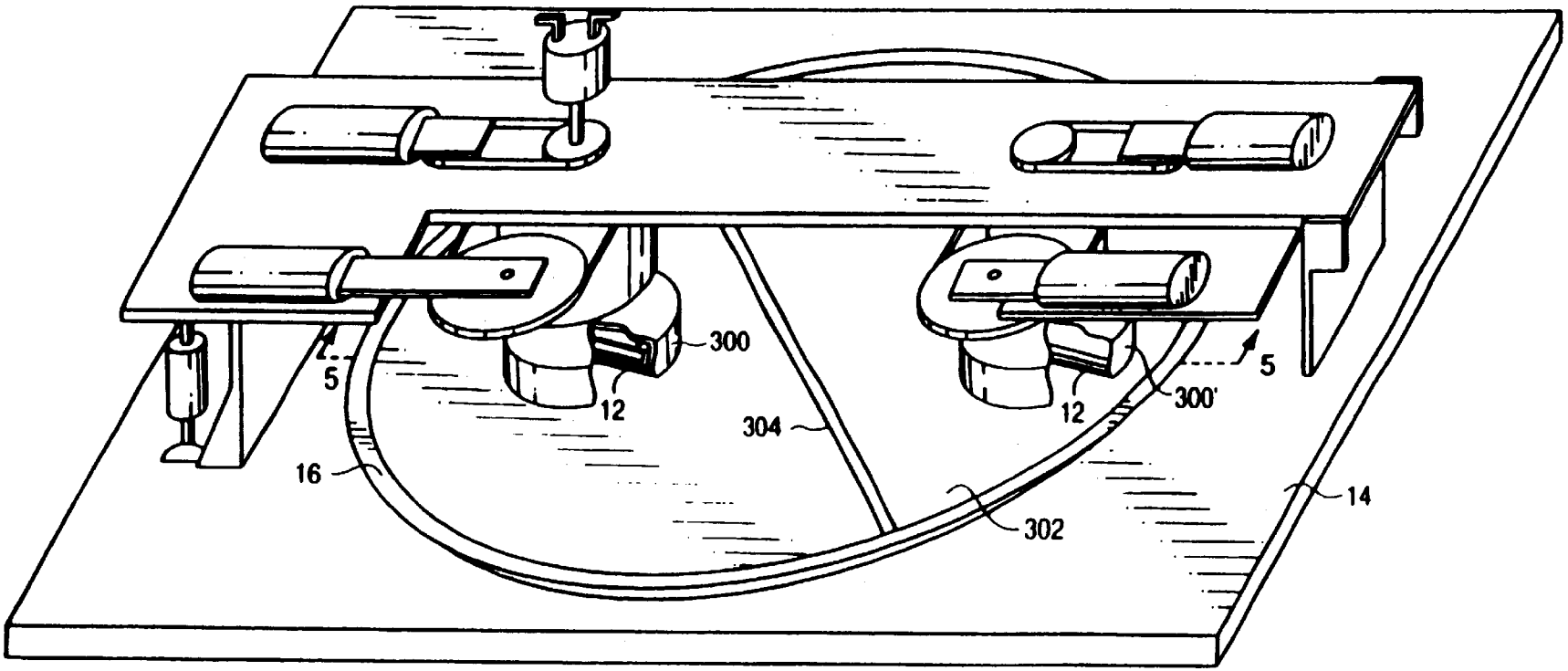
FIG. 4 is a perspective view of an alternative embodiment of the polishing apparatus of FIG. 1, showing the operation of two polishing heads on the polishing pad.
Figure 5:
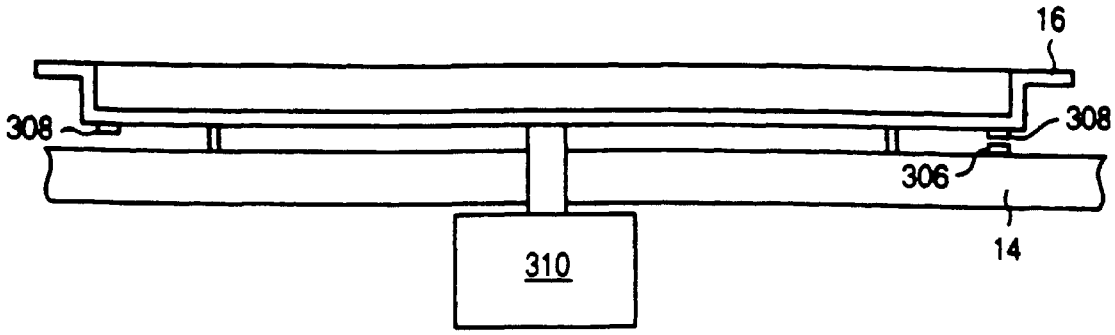
FIG. 5 is a partial, sectional view of the apparatus of FIG. 4 at 5—5.
Figure 6:
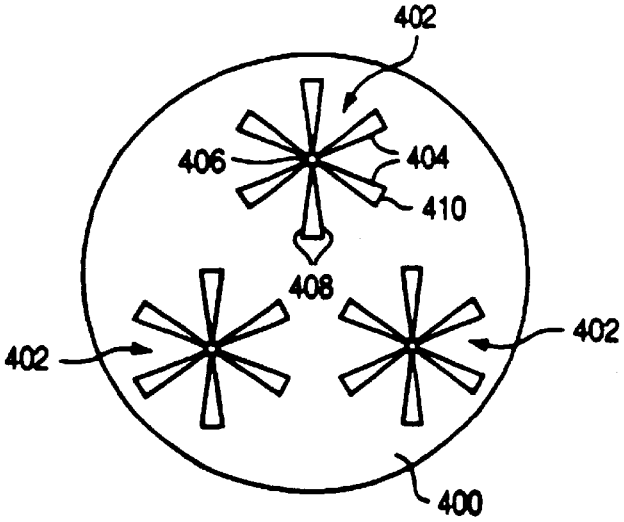
FIG. 6 is a top view of an alternative embodiment of the polishing pad of the present invention, showing the details of an alternative polishing pad configuration.

In the embodiments of the invention shown in FIGS. 4 to 6, apparatuses are shown for simultaneously polishing multiple substrates 12 on a single polishing pad 302 or 400. In FIGS. 4 and 5, the multiple substrates 12 are loaded against a split polishing pad 302, which preferably rotationally oscillates to prevent the area of the split polishing pad 302 in contact with any one substrate 12 from coming into contact with any other substrate 12 being polished thereon. In FIG. 6, a lobed polishing pad 400 having lobes 404 or recesses in the surface thereof is provided. The lobes are clustered in groups, such that a substrate 12 may be orbited, rotated, vibrated, oscillated or otherwise moved against a single group of lobes 404. Preferably, the lobed polishing pad 400 remains stationary, and all relative motion between the substrate 12 and the lobed polishing pad 400 is provided by moving the substrate 12.

II. The Polishing Apparatus

Referring now to FIG. 1, a polishing apparatus 10 useful for polishing substrates using any of the embodiment of the invention described herein is shown. Although the apparatus 10 is useful with each of the embodiments of the invention described herein, for ease of illustration it is described in conjunction with the carrier 24 and polishing pad 22. The polishing apparatus 10 generally includes a base 14 which supports a rotatable platen 16 and the polishing pad 22 thereon, a carrier 24 which receives it and positions the substrate 12 on the polishing pad 22, and a transfer case 54 connected to the carrier 24 to load and move the substrate 12 with respect to the polishing pad 22. If rotation of the polishing pad 22 is desired, a motor and gear assembly, not shown, is disposed on the underside of the base 14 and is connected to the center of the underside of the platen 16 to rotate the platen 16. The platen 16 may be supported from the base 14 on bearings, or the motor and gear assembly may simultaneously rotate and support the platen 16. The polishing pad 22 is located on the upper surface of the platen 16 and is thereby rotated by the motor and gear assembly.

A slurry is provided on the polishing pad 22 to enhance the polishing characteristics of the polishing pad 22. The slurry may be supplied to the polishing pad 22 through a slurry port 23 which drips or otherwise meters the slurry onto the polishing pad 22, or it may be supplied through the platen 16 and the underside of the polishing pad 22 so that it flows upwardly through the polishing pad 22 to the substrate 12. The polishing pad 22 and the slurry are selected to provide the desired polishing of the substrate 12. The composition of the polishing pad 22 is preferably a woven polyeurethane material, such as IC 1000 or Suba IV, which is available from Rodel of Newark, Pa. One slurry composition which provides enhanced selective polishing of materials deposited on the substrate is an aqueous solution having 5% NaOH, 5% KOH, and colloidal silica having a size of approximately 200 nm. Those skilled in the art may easily vary the polishing pad 22 material and the slurry composition to provide the desired polishing of the substrate 12.

To properly position the carrier 24 with respect to the polishing pad 22, the transfer case 54 is connected to a crossbar 36 that extends over the polishing pad 22. The crossbar 36 is positioned above the polishing pad 22 by a pair of opposed uprights 38, 39 and a biasing piston 40. The crossbar 36 is preferably connected to the upright 38 at a first end 44 thereof with a hinge, and is connected to the biasing piston 40 at a second end 46 thereof. The second upright 39 is provided adjacent the biasing piston 40, and it provides a vertical stop to limit the downward motion of the second end 46 of the crossbar 36. To change a substrate 12 on the carrier 24, the crossbar 36 is disconnected from the biasing piston 40, and the second end 46 of the crossbar 36 is pulled upwardly to lift the carrier 24 connected to the crossbar 36 off the polishing pad 22. The substrate 12 is then changed, and the carrier 24 is lowered to place the face 26 of the substrate 12 against the polishing pad 22.

A. The Transfer Case

Referring still to FIGS. 1 and 2, the configuration and details of construction of the transfer case 54 necessary to provide the preferred orbital and controlled rotational motion of a substrate 12 on the polishing pad 22 are shown. Again, for ease of illustration, the transfer case 54 is described in conjunction with the carrier 24. However, the transfer case 54 is specifically constructed to interchangeably drive any carrier in an orbital motion, including the front referencing carrier 200. The transfer case 54 is suspended below the crossbar 36 to link the carrier 24 to the cross bar 36. The transfer case 54 generally includes a drive shaft 56 and a housing 58. The drive shaft 56 extends upwardly through the crossbar 36 to connect to a motor and drive assembly 50 which is rigidly connected to the cross bar 36, and downwardly through the housing 58 to transfer rotational motion of the motor and drive assembly 50 into orbital and controlled rotational motion of the carrier 24. To rotate the drive shaft 56, a drive belt 52 connects the drive shaft 56 to the motor and gear assembly 50. Additionally, a drive sprocket 88 is located on the outer surface of the housing 58. This drive sprocket 88 is connected by a drive belt 61 to a housing drive motor 90 located on the cross arm 36. Although the housing 58 is shown as having a sprocket 88 located thereon, other configurations for transferring rotary motion, such as sheaves or pulleys, may be easily substituted for the sprocket 88.

Referring now to FIG. 2, the internal details of construction of the transfer case 54 are shown. The housing 58 includes an inner fixed hub 57 and an outer rotatable hub 59. The inner fixed hub 57 of the housing 58 is rigidly secured to the underside of the crossbar 36, preferably by a plurality of bolts or other releasable members (not shown). The outer rotatable hub 59 is journalled to the inner fixed hub 57, preferably by upper and lower tapered bearings. These bearings provide vertical support to the outer rotatable hub 59, while allowing the outer rotatable hub 59 to rotate with respect to the inner fixed hub 57. The drive shaft 56 is extended through the inner fixed hub 57 of the housing 58 and is likewise supported therein on tapered beatings which provide vertical support for the drive shaft 56 and allow the drive shaft 56 to rotate with respect to the inner fixed hub 57. To rotate the outer rotatable hub 59, the sprocket 88 is directly mounted thereto.

1. The Orbital Drive Portion of the Transfer Case

To provide the orbital motion to orbit the carrier 24, a cross arm 60 is provided on the lower end of the drive shaft 56. The cross arm 60 includes a first end and a second end. The first end of the cross arm 60 receives the lower end of the drive shaft 56 therein, and the second end of the cross arm 60 supports a second shaft 64 extending downwardly therefrom. The lower end of the second shaft 64 terminates in the center of a carrier plate 80, which forms the upper terminus of the carrier 24. A bearing assembly 79 is provided in the carrier plate 80 to receive the lower end of the second shaft 64. As the drive shaft 56 rotates, it sweeps the second end of the cross arm 60, and thus the shaft 64 extending downwardly therefrom, through a circular arc. The radius of this arc, which is the distance between the drive shaft 56 and the second shaft 64, defines the radius of the orbital path through which the carrier 24 is moved. The connection of the second shaft 64 to the bearing assembly 79 allows the carrier 24 to move rotationally with respect to the second shaft 64 as the second shaft 64 pushes the carrier 24 through an orbital path. The lower end of the second shaft 64 also forms a rigid bearing point against which the carrier 24 bears when loading a substrate 12 against the polishing pad 22.

2. The Rotational Compensation Portion of the Transfer Case

The connection of the second shaft 64 to the carrier 24 is configured to impart minimal rotational force on the carrier 24 and to minimize the rotation of the substrate 12 and the carrier 24 as the substrate 12 is orbited on the polishing pad 22. The dynamic interaction between the substrate 12 and the polishing pad 22, and between the carrier 24 and the second shaft 64, will, however, cause the substrate 12 to slowly precess as it orbits. To control or eliminate the rotation of the substrate 12 as it orbits, a rotational compensation assembly 62 is provided on the underside of the housing 58 to positively position the substrate 12 as it is orbited. To provide this positive positioning, the compensation assembly 62 includes an internally toothed ring gear 70 disposed on the underside of the outer rotatable hub 59 of the housing 58, and a pinion gear 74 located on the second shaft 64 immediately below the cross arm 60. The pinion gear 74 includes an outer toothed surface, which engages the teeth of the ring gear 70, and an inner diameter which is received over a bearing 77 on the second shaft 64. The pinion gear 74 is rotationally fixed with respect to the carrier plate 80 by a pair of pins 73 which extend from the pinion gear 74 to a pair of mating recesses 75 in the carrier plate 80. Therefore, as the second second shaft 64 orbits, orbital motion of the shaft 64 is transferred into the carrier plate 80 through the bearing 79, and rotational motion of the pinion gear 74 is transferred to the carrier plate 80 through the pins 73.

The compensation assembly 62 allows the user of the CMP equipment to vary the rotational component of motion of the carrier 24, and thereby prevent or precisely control the rotation of it as the carrier 24 orbits. As the cross arm 60 rotates about the drive shaft 56, it sweeps the pinion gear 74 around the inner periphery of the the ring gear 70. Because the teeth of the pinion gear 74 and ring gear 70 mesh, the pinion gear 74 will rotate with respect to the ring gear 70 unless the teeth of the ring gear 70 are moving at the same velocity as the teeth on the pinion gear 74. By rotating the outer rotatable hub 59 of the housing 58 while simultaneously rotating the drive shaft 56, the effective rotational motion of the pinion gear 74 about the second shaft 64, and of the carrier 24 attached thereto, may be controlled. For example, if the ring gear 70 is rotated at a speed sufficient to cause the pinion gear 74 to make one complete revolution as the carrier 24 makes one orbit, the pinion gear 74, and thus the orbiting carrier 24 attached thereto, will not rotate with respect to a fixed reference point such as the base 14. Additionally, the speed of rotation of the carrier 24 may be matched to, or varied from, the speed of rotation of the polishing pad 22 by simply changing the relative rotational speeds of the drive shaft 56 and the outer rotatable hub 59 of the housing 58. This physical phenomena is used to control the rotational velocity of the carrier 24 as it is orbited by changing the relative speeds of the ring gear 70 and pinion gear 74.

The configuration of the transfer case 54 allows the user of the CMP equipment to closely control the uniformity of the polishing rate across the face 26 of the substrate 12 by controlling the relative speeds at different locations on the face 26 as the substrate 12 is polished. As the substrate 12 is moved by the carrier 24 in an orbital path on the polishing pad 22, the platen 16 and the polishing pad 22 are rotated by the motor and gear assembly (not shown). The orbital speed of the substrate 12 and the rotational speed of the polishing pad 22 combine to provide a nominal speed at the surface 26 of the substrate of 1800 to 4800 centimeters per minute. Preferably, the orbital radius is not more than one inch, and the polishing pad 22 rotates at a relatively slow speed, less than 10 rpm and most preferably at less than 5 rpm.

The orbiting substrate 12 may be rotated, or may orbit without rotation, by selectively rotating the housing 58 with the motor 90. By rotating the orbiting substrate 12 at the same speed as the polishing pad 22, the cumulative motion between the polishing pad 22 and every point on the substrate 12 may be uniformly maintained. Therefore, over-polishing attributable to differential cumulative motions on different areas of the substrate is eliminated. Additionally, the rotational speed of the substrate may be varied from the rotational speed of the polishing pad 22 to increase the relative motion between the edge of the substrate and the polishing pad 22, as compared to the center of the substrate if desired. The substrate 12 may even be moved in a rotational direction opposite to the direction of the polishing pad 22 if desired.

B. The Substrate Carrier

Referring still to FIG. 2, the structure of one preferred embodiment of the carrier 24 is shown in detail. The carrier 24 includes an internal biasing member 30 therein, which selectively controls the application of the primary and secondary forces used to load the substrate 12 on the polishing pad 22, and an outer sleeve portion 130 which transfers orbital motion to the substrate 12. The internal biasing member 30 includes an upper biasing portion 102 and a lower body portion 104.

The upper biasing portion 102 of the carrier is configured to control the primary pressure provided to load the substrate 12 against the polishing pad 22. To control the primary load pressure, the upper biasing portion 102 of the carrier 24 is configured as a cavity 112 which is selectively pressurized to load the substrate 12 against the polishing pad 22. The cavity 112 is defined by the carrier plate 80, which forms its upper terminus, the upper surface of the lower body portion 104, which forms its lower terminus and a bellows 110, which extends downwardly from carrier plate 80 to the lower body portion 104 and forms the outer wall of the cavity 112. The bellows 110 is preferably manufactured from stainless steel, approximately 8 thousandths of an inch thick, and supplies sufficient rigidity to prevent substantial twisting of the carrier 24. The bellows 110 also transfers rotational motion from the carrier plate 80 to the substrate 12. The lower body portion 104 of the carrier 24 is used to finely adjust the load pressure between the substrate 12 and the polishing pad 22 at different locations on the substrate 12. The lower body portion 104 is a generally right circular hollow member, having a generally circular upper wall 138 received within the sleeve portion 130, and which forms the connection between the lower end of the bellows 110 and the lower body portion 104. An outer circular wall 140 extends downwardly from the circular member 138 and terminates on a lower contoured wall 142. The circular member 138, the outer wall 140 and the lower contoured wall 142 form the outer boundaries of a chamber 144. The lower contoured wall 142 has a generally flat outer surface 152 and a contoured inner surface. Preferably, the contour of the inner surface of the lower contoured wall 142 includes a sloped surface forming a tapered portion 146 extending from the outer circumference of the contoured wall 142 to a surface approximately one-third of the radius thereof, and a flat portion 148 forming a constant thickness portion 150 in the center of the contoured wall 142. The constant thickness portion 150 is thinner than any portion of the tapered portion 146. The outer, or lower, surface 152 of contoured wall 142 is flat, and it preferably receives a layer of a film 154 thereon, preferably a closed cell film. The lower end of the sleeve 130 extends downwardly beyond the outer surface 152 of the contoured wall 142 and the film 154 thereon, and, in conjunction with the contoured wall 142, forms a lower substrate receiving recess 28.

The sleeve portion 130 is configured to receive the components of the internal biasing portion 30 therein and to guide these components and the substrate 12 in an orbital path. Sleeve portion 130 includes an upper, generally right annular member 132, which is connected, at its upper end, to the lower end of the carrier plate 80, and a lower, generally right circular ring 134, which is connected to the lower side of the annular member 132 and is biasable downwardly into engagement with the polishing pad 22 by a circular leaf spring 128 disposed at the connection of the annular member 132 and the ring 134. The sleeve portion 130 provides a strong, substantially rigid, member which receives the lower body portion 104 therein and guides the lower body portion 104 through the orbital path. The circular ring 134 is preferably a conformable member, which will conform slightly as a substrate 12 loads against it.

To provide the load pressure between the substrate 12 and polishing pad 22, a fluid must be supplied under pressure to the cavity 112 and the chamber 144. Further, the fluid supplied to the cavity 112 must be independently maintainable at different pressures than that which is supplied to the chamber 144. To provide these fluids, the drive shaft 56 includes a pair of passages 160, 162 extending longitudinally therethrough. Likewise, the second shaft 64 includes passages 160', 162' extending longitudinally therethrough. A rotary union 164 is provided over the upper end of the drive shaft 54 to provide the fluid into the passages 160, 162. Rotary unions are also located at the connection of the cross arm 60 to both of the drive shaft 56 and the second shaft 64, and the cross arm 60 includes a pair of passages therethrough (not shown) which, in conjunction with the rotary unions, pass the fluid from passage 160 into passage 160', and from passage 162 into passage 162'. Passage 160' provides fluid, under pressure, to selectively pressurize the cavity 112. A hose 124 is connected to the lower terminal end of passage 162' with a rotary fitting and extends from passage 162' to an aperture 126 in lower body portion to supply fluid to chamber 144 of lower body portion 104. The fluid is preferably supplied from a variable pressure source, such as a pump having multiple, throttled output, regulated gas supplies, regulated pressurized liquid sources, or other pressurized fluid supplies.

To load the substrate 12 against the polishing pad 22, fluid is supplied, under pressure, to the cavity 112 and the chamber 144. The pressure supplied by the fluid to the cavity 112, in conjunction with the weight of the components loading against the carrier 24 and the weight of the carrier 24 itself, creates a primary loading pressure of the substrate 12 against the polishing pad 22 of 0.3 to 0.7 kg/cm.sup.2. If edge over-polishing does not occur as the substrate 12 is polished, the chamber 144 is maintained at ambient pressure. However, if over-polishing occurs at the edge of the substrate 12, the chamber 144 is pressurized at a pressure sufficient to deflect the contoured lower wall 142, particularly the flat surface 148 in the center thereof, outwardly by a sufficient distance to additionally differentially bias the center of the substrate 12 downwardly against the polishing pad 22. The pressure supplied to the chamber 144 may be varied to control the deflection of the constant thickness portion 150 to increase the polishing rate at the center of the substrate 12 until it is equal to the polishing rate at edge of the substrate 12. The amount of deflection desirable for a given substrate polishing operation will be established during manufacture, once a history of polishing and edge over-polishing is established.

Although the carrier 24 has been described for providing a compensating force to increase the loading force between the polishing pad 22 and the substrate 12 near the center of the substrate 12, it may also be used to reduce the pressure at the center of the substrate 12 to address center over-polishing. This may be accomplished by evacuating the chamber 144. Additionally, the configuration of the carrier 24 may be varied to provide greater force at the edge of the substrate 12, or at different radial positions on the substrate 12, by changing the contour of the lower contoured wall 142.

C. The Alternative Substrate Carrier

Referring now to FIG. 3, an alternative embodiment of the carrier is shown, preferably for use with the transfer case 54. In this alternative embodiment, the substrate carrier is configured as a front referencing carrier 200 to load the surface 26 of the substrate 12 evenly against the polishing pad 22. The front referencing carrier 200 evenly loads the back side of the wafer, and this causes the front of the substrate 12 to be loaded evenly, i.e., front referenced, against the polishing pad 22. The front referencing carrier 200 includes a right circular body 204 having an upper, shaft receiving portion 206, and an outer circumferential wall 208 extending downwardly from the upper, shaft receiving portion 206, which together form the boundary of a bladder cavity 210. The lower end of the second shaft 64 of the transfer case 54 is received in a bearing in the center of the shaft receiving portion 206 to impart orbital movement to the front referencing carrier 200. The second shaft 64 also supplies a vertically rigid bearing point against which the carrier 200 bears when loading the substrate 12 on the polishing pad 22. To control the rotation of the front referencing carrier 200, the pins 73 of the transfer case 54 extend downwardly from the pinion gear 74 and are received in mating apertures 75 in the shaft receiving portion 206 of the carrier 200.

The bladder cavity 210 is configured to receive an elastic and rubber-like bladder 214 therein. A lower end 212 of the bladder cavity 210 is open and is sized to receive a substrate 12 therein. When received in the carrier lower end 212, the substrate 12 contacts the bladder 214 extending across the lower end 212. To limit the inward movement of the substrate 12 into the bladder cavity 210, and to prevent deflation of the bladder 214 into the bladder cavity 210 when the bladder 214 is not pressurized, a limit plate 216 is located inwardly of the lower end 212 of the bladder cavity 210, within the envelope of the bladder 214. The limit plate is rigidly connected to the inner wall of the bladder cavity 210, such that the portion of the bladder 214 extending therepast is pinched between the inner wall of the bladder cavity 210 and the edge of limit plate 216 Alternatively, the inner wall of the bladder cavity 210 includes multiple recessed grooves therein, and the limit plate 216 includes a plurality of tabs which are received in the recessed grooves. The bladder 214 may also extend into the recessed grooves over the tabs, or the tabs may extend through the bladder 214 and the area around the tab may be sealed to maintain the integrity of the bladder 214. To maintain the substrate 12 in the lower end 212 of the bladder cavity, a sleeve 220 is provided on the lower end of the downwardly extending wall 208. The sleeve 220 is preferably manufactured from a conforming material, such as a plastic material, which will conform slightly when a substrate is loaded against it. The sleeve 220 is preferably biased downwardly into engagement with the polishing pad 22 by a circular leaf spring, or other biasing member (not shown), located at the interface of the sleeve 220 and the downwardly extending wall 208.

The front referencing carrier 200 is preferably positioned on the polishing pad 22 by the transfer case 54, which is configured to impart orbital and selective rotational motion to the front referencing carrier 200. To provide the primary loading of the substrate 12 against the polishing pad 22, the bladder 214 is pressurized. Preferably, a fluid such as air, is routed through the drive shaft 58 and the second shaft 64 to supply air to the bladder. When the bladder 214 is pressurized, it expands in the bladder cavity 210 and forces the substrate 12. downwardly against the polishing pad 22. Simultaneously, the expanding bladder 214 separates from the limit plate 216 and lifts the body 204 of the carrier 200 slightly upwardly with respect to the substrate 12, but this movement is limited by the fixed lower end of the second shaft 64. Therefore, as the bladder 214 is further pressurized, the body 204 of the carrier 200 bears on the lower end of the second shaft 64 and the load on the substrate 12 is increased. The load placed on the substrate 12 by the front referencing carrier 200 loads the face 26 of the substrate evenly against the polishing pad 22, because the bladder 214 does not impart an uneven load on the rear side of the substrate 12. Therefore, the differential polishing that commonly occurs when the substrate 12 is unevenly loaded by projecting areas on the carrier, or in the conformable material, is substantially eliminated.

III. The Multiple Substrate Polishing Configurations

Referring now to FIG. 4, an alternative apparatus for polishing multiple substrates 12 on a single rotating platen 16 is shown. In this alternative embodiment, two polishing heads 300, 300' are located on a split polishing pad 302. Each head 300, 300', may be orbited, oscillated, vibrated, rotated or otherwise positioned with respect to the split polishing pad 302. Heads 300, 300' may be configured as the carrier 24, the front referencing carrier 200, or other carrier configurations capable of maintaining a substrate 12 against the split polishing pad 302. The heads 300, 300' are preferably orbited to move the substrates 12 therein with respect to the split polishing pad 302, but may alternatively be vibrated, oscillated or rotated to provide motion with respect to the split polishing pad 302.

One problem associated with polishing multiple substrates 12 on a single polishing pad is the concern by CMP apparatus users that a substrate 12 may chip or crack. If a substrate 12 chips, a piece of the damaged substrate 12 can move into contact with, and damage, one or more other substrates 12. The present invention overcomes this problem by rotationally oscillating the split polishing pad 302 such that no portion of the split polishing pad 302 which contacts the substrate 12 in head 300 can contact the substrate 12 in head 300', and vice versa. To provide this motion, the split polishing pad 302 moves in a first rotational direction and then moves in the opposite rotational direction. A hi-directional motor 310 is provided on the underside of the base 14 as shown in FIG. 5 and is selectively actuated to sequentially rotate the split polishing pad 22 in opposite directions. The movement of the split polishing pad 302 in either direction is insufficient to allow any portion of the split polishing pad 302 to contact more than one substrate 12. This ensures that approximately one-half of the split polishing pad 302 will move only under head 300, and approximately one-half of the split polishing pad 302 will move only under head 300'. Additionally, to further prevent the transfer of contaminants from one substrate 12 to another, a groove 304 may be provided in the split polishing pad 302 to receive, and collect, any particulates which may become disengaged from any one substrate 12. Further, where the groove 304 is used, the polishing pad may be continuously rotated because chips or other particulate contaminants will collect in the groove 304 and thus not come into contact with another substrate 12.

To rotationally oscillate the platen 16 and the split polishing pad 302, a triggering means is provided to cause the bi-directional motor 310 to reverse after a desired rotational movement has occurred. One apparatus for triggering the reversal of the motor is shown in FIG. 5. This triggering means includes a magnetic pickup 306 connected to the base 14 below the platen 16. A pair of magnets 308 are affixed to the underside of the platen 16, and are spaced apart by an arcuate distance equal to the desired arcuate movement of the platen 16 before reversal occurs. When either magnet 308 enters the proximity of the pickup 306, a signal is sent to a controller. The controller then reverses the hi-directional motor 310, thereby reversing the rotational motion of the motor and the platen 16. Thus, the platen 16 will rotationally oscillate between the magnets 308 until the motor is stopped or disengaged.

IV. The Lobed Polishing Pad

Referring now to FIG. 6, a further alternative embodiment of a lobed polishing pad 400 useful for simultaneously polishing one or more substrates 12 is shown. In this embodiment, the lobed polishing pad 400 includes one or more multi-lobed groove members 402 therein, which are located on the polishing pad 400 in a location to receive a substrate 12 thereover. Each groove member 402 includes a plurality of lobes 404 which extend radially from a central recessed area 406. Preferably, each lobe 404 is substantially triangular, having opposed extending sides 408 terminating in an arcuate end 410. Although the lobes 404 are shown as having flat sides, other configurations are specifically contemplated. For example, the lobes 404 may be curvilinear, or the lobes 404 may define a plurality of depressions, having rectilinear or curvilinear profiles configured in a closely spaced area of the pad 400. Further, it is preferred that the lobes 404 interconnect into the central recessed area 406, such that slurry may be provided through the polishing pad 22 and into the central recessed area 406 to pass into the lobes 404. Preferably, at least two lobes 404 are provided, although one lobe may also be used. The lobes 404 are sized so that the lobes 404, in conjunction with the material of the polishing pad 400 between the lobes 404, extend over an area equal to the entire orbital, vibratory, oscillatory or rotary path of a substrate 12 on the polishing pad 400. The lobed groove members 402 are preferably used in conjunction with a substrate carrier which is driven by an orbital drive member having rotational positioning control such as the transfer case 54 shown in FIGS. 1 to 3, and the lobed polishing pad 400 is maintained in a stationary position. Alternatively, the lobed polishing pad 400 may be oscillated, vibrated or orbited under a stationary, or moving, substrate 12, to supply relative motion between the substrate 12 and the lobed polishing pad 400. The lobes 404 provide a slurry replenishment reservoir at the surface of the substrate engaged against the lobed polishing pad 400 to continuously replenish the slurry at that surface as the substrate 12 is polished on the lobed polishing pad 400. Although the lobed groove members 402 are shown in FIG. 6 as configured for polishing multiple substrates 12 on a single lobed polishing pad 400, the lobed polishing pad 400 may be sized only slightly larger than the substrate 12, and single substrates 12 may be sequentially processed thereon.

Although the use of lobed groove members 402 has been described herein, other groove configurations may also be used to provide slurry to the underside of the substrate 12. For example, if the polishing pad 22 is rotated, the pad may include one or more grooves therein, which extend radially, and preferably radially and circumferentially, in the polishing pad 22 surface, Thus, as the polishing pad 22 passes under the substrate 12, the grooves will sweep under the substrate to replenish the slurry supply to the substrate 12. Such grooves are discussed in detail in U.S. patent application Ser. No. 08/205,278 entitled Chemical Mechanical Polishing Apparatus with Improved Slurry distribution by Homoyoan, Talieh, filed concurrently herewith.

V. Conclusion

The foregoing embodiments provide apparatus which can be used to increase the number of useful die produced from the substrates processed by chemical mechanical polishing by decreasing the incidence of localized over-polishing and providing apparatus to simultaneously polish multiple substrates on a single polishing pad. The improvements disclosed herein will decrease the number of defective die created on the substrate resulting from the otherwise inherent limitations of the chemical mechanical polishing process. Although specific materials and dimensions have been described herein, those skilled in the art will recognize that the sizes and materials disclosed herein may be changed without deviating from the scope of the invention.

What is claimed is:

1. A carrier for a polishing apparatus, comprising:

a housing;

a biasing member coupled to and vertically movable relative to the housing, the biasing member including a substrate receiving surface and a first chamber to control a pressure applied by the substrate receiving surface; and a second chamber between the housing and the biasing member to control a pressure on the biasing member.

2. The carrier head of claim 1, wherein the biasing member is configured to apply different pressures to different regions of a substrate on the substrate receiving surface.

3. The carrier head of claim 2, wherein the biasing member includes a lower wall that forms a boundary of the first chamber, and the lower wall is configured to apply different pressures to different regions of a substrate positioned on the substrate surface.

4. The carrier head of claim 3, wherein the lower wall includes regions of different thickness.

5. The carrier head of claim 4, wherein the lower wall includes an inner region and an outer circumferential region, and the inner region is thinner than the outer circumferential region.

6. The carrier head of claim 1, wherein the biasing member includes a lower wall that forms a boundary of the first chamber.

7. The carrier head of claim 6, wherein the biasing member includes a film on a bottom surface of the lower wall, the film providing the substrate receiving surface.

8. The carrier head of claim 1, further comprising a retaining ring to maintain a substrate below the substrate receiving surface.

9. A carrier head for a polisher, comprising:

a housing;

a biasing member including a substrate receiving surface and a first chamber to control a pressure applied by the substrate receiving surface, the biasing member movable coupled to and movable relative to the housing, the biasing member configured to apply different pressures to different regions of a substrate positioned on the substrate receiving surface; and a second chamber between the housing and the biasing member to control a pressure on the biasing member.

10. The carrier head of claim 9, wherein the biasing member includes a lower wall that forms a boundary of the first chamber, and the lower wall is configured to apply different pressures to different regions of the substrate.

11. The carrier head of claim 10, wherein the lower wall includes regions of different thickness.

12. The carrier head of claim 11, wherein the lower wall includes an inner region that is thinner than an outer circumferential region.

13. The carrier head of claim 10, wherein the biasing member includes a film on a bottom surface of the lower wall, the film providing the substrate receiving surface.

14. The carrier head of claim 9, further comprising a retaining ring to maintain a substrate below the substrate receiving surface.

* * * * *